United States Patent [19]

Yamamoto et al.

[11] 4,250,404

[45] Feb. 10, 1981

[54] ELECTROMAGNETIC COUNTERS

[75] Inventors: Yukio Yamamoto; Takeo Tezuka, both of Yonezawa, Japan

[73] Assignee: Tamura Electric Works, Ltd., Tokyo, Japan

[21] Appl. No.: 10,225

[22] Filed: Feb. 8, 1979

[30] Foreign Application Priority Data

Apr. 12, 1978 [JP] Japan ..... 53/46989[U]

[51] Int. Cl.[3] ..... G06M 3/12

[52] U.S. Cl. ..... 235/92 FP; 235/92 C

[58] Field of Search ..... 235/92 C, 92 FP, 92 R

[56] References Cited

U.S. PATENT DOCUMENTS 3,619,577 11/1971 Hoffman ..... 235/92 C 3,761,015 9/1973 Cook ..... 235/92 C 4,031,361 6/1977 Moll et al. ..... 235/92 FP

*Primary Examiner*—Joseph M. Thesz

*Attorney, Agent, or Firm*—Charles E. Pfund

[57] ABSTRACT

The counter is provided with a plurality of digit wheels, the first order digit wheel thereof having a star wheel on one side, a plurality of pinions for effecting carries of the digit wheels, a pair of pawls driven by a driving member for alternately engaging the pawls with the star wheel, an electromagnetic driving device for driving the star wheel through the driving member, and a control member including cam members for preventing the tilting of the driving member when an external shock or vibration is applied to the counter tending to swing the driving member thus causing the misoperation of the star wheel.

2 Claims, 5 Drawing Figures

ELECTROMAGNETIC COUNTERS

BACKGROUND OF THE INVENTION

This invention relates to an electromagnetic counter, more particularly an electromagnetic counter having shock and vibration preventing mechanisms for preventing misoperations when external shocks and vibrations are applied to the counter.

As is well known in the art, an electromagnetic counter generally comprises a plurality of digit wheels, pinions for transmitting the rotation of the digit wheels, a driving member for driving the digit wheels, and an electromagnetic driving device for imparting a driving force to the driving member, and is incorporated into industrial machines and business machines for displaying their number of operations and the number of inputs, Recently, electromagnetic counters are incorporated into automatic vending machines, game machines etc., for counting the number of inserted coins, the number of merchandise sold and the number of games. Different from industrial machines and business machines which are used by specific operators, automatic vending machines and game machines are used by a plurality of not specified persons including wild acting men who often beat or shake the machines. Since electromagnetic counters are precision machines they are liable to misoperate when shocks or vibration are applied. On the otherhand, electromagnetic counters to be incorporated into such automatic machines and game machines are required to be of low price. A low price electromagnetic counter is disclosed in Japanese Utility model laid open publication No. 71451/1977 in which a portion of the counter frame is used as the yoke of the electromagnetic driving device and the armature comprising a portion of the electromagnetic driving device is formed integral with a driving member for the digit wheels for the purpose of decreasing the cost. However in this electromagnetic counter, the force of an armature spring which urges the pawl of the driving member into engagement with the gears of the digit wheels is divided into two directions with respect to the direction of operation of the armature so that when an external shock or vibration is applied, the driving member integral with the armature tends to operate readily. Inadvertent operation of the driving member results in unwanted driving of the digit wheels thus causing the electromagnetic counter to misoperate. For this reason, in this electromagnetic counter there is provided a member for resiliently supporting a star wheel integrally constructed with the digit wheel. With this construction, however, since the driving member is not held directly it is difficult to prevent misoperation. Moreover, under normal counting operations the driving member imposes a load on means for driving the star wheel.

SUMMARY OF THE INVENTION

Accordingly, it is the principal object of this invention to provide an electromagnetic counter which does not misoperate when subjected to external shock or vibration.

Another object of this invention is to provide an improved electromagnetic counter provided with means for preventing misoperation against external shock or vibration, and has a simple construction and is easy to fabricate.

Still another object of this invention is to provide a novel electromagnetic counter incorporated with means for preventing misoperation against external shock or vibration and wherein the digit wheels can be operated by the same driving force as the prior art counter, and the counter has the same appearance, size and shape as the prior art counter.

According to this invention, there is provided an electromagnetic counter comprising a frame including a pair of spaced parallel side plates; a plurality of digit wheels rotatably mounted on a shaft extending between the side plates, a first order digit wheel of the plurality of digit wheels including a star wheel on one side thereof; a plurality of pinions rotatably mounted on a pinion shaft extending between the side plates in parallel with the first mentioned shaft for effecting carries of the digit wheet; a driving member including a pair of pawls alternately engaging the star wheel for driving the same; electromagnetic driving means mounted on the frame for causing the driving member to drive the star wheel; and a control member pivotally mounted on one side plate near the driving member for preventing the driving member from swinging or advancing when an external shock or vibration is applied to the counter thus causing the star wheel to misoperate.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 3:
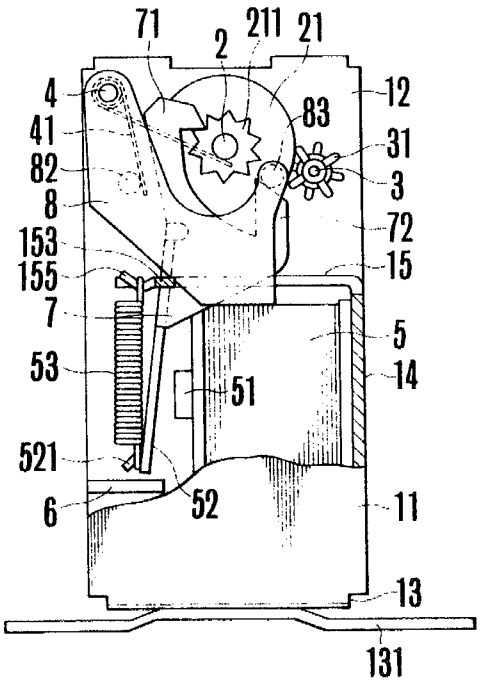
FIG. 3 is a righthand side view with a portion of the righthand side plate of the frame cut away.
Figure 1:
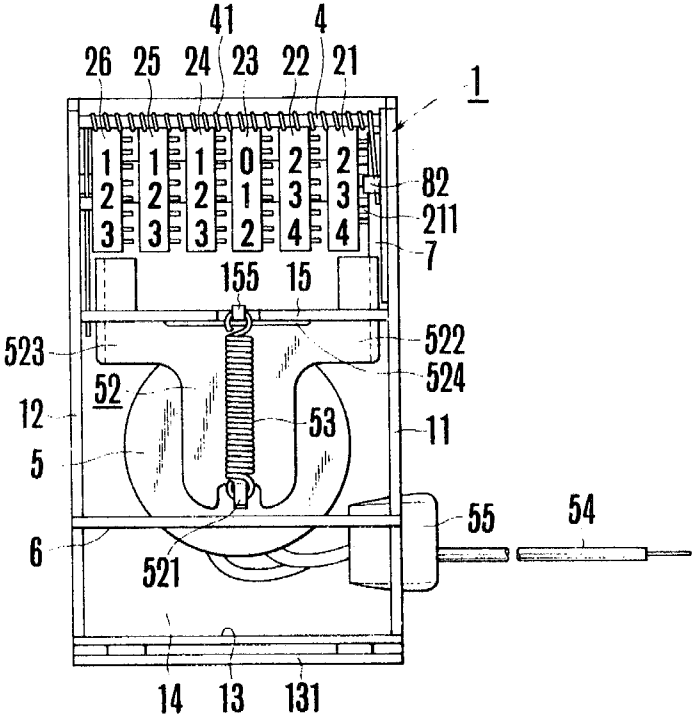
FIG. 1 is a plan view showing one embodiment of the electromagnetic counter according to this invention.
Figure 2:
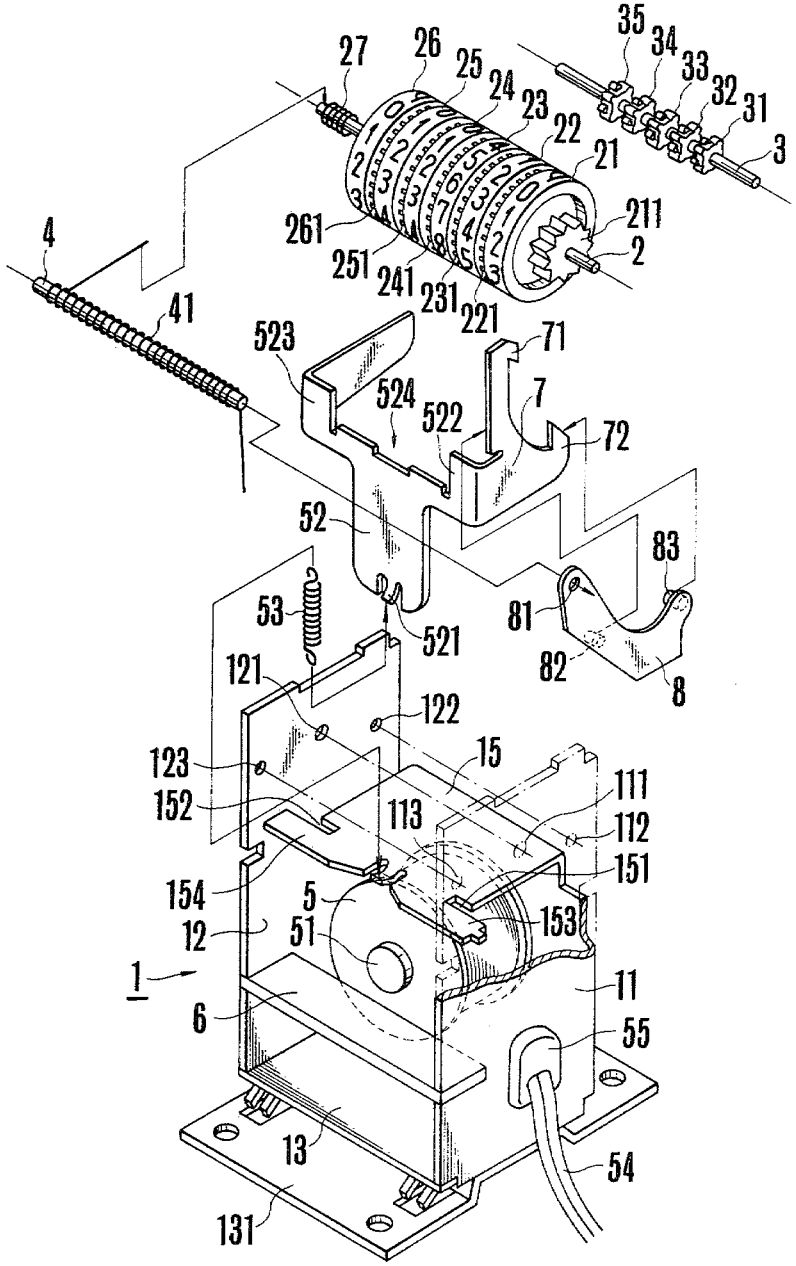
FIG. 2 is an exploded view of the electromagnetic counter shown in FIG. 1.
Figure 5:
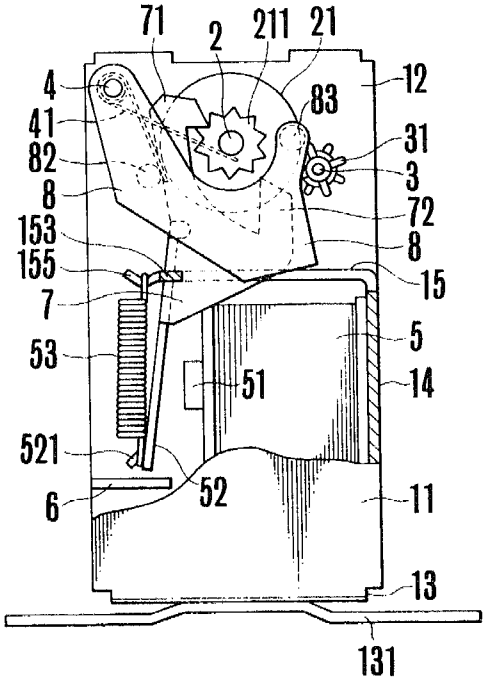
FIG. 5 is a view similar to FIG. 3 showing the manner of preventing misoperations.

The electromagnetic counter illustrated in the accompanying drawings comprises a counter frame 1 prepared by a press work of a magnetic metal sheet. The counter frame 1 comprises a pair of parallel opposed side plates 11 and 12, a U shaped bottom plate 13 interconnecting the rear sides of the side plates and a back plate 14 with its three sides connected to the side plates 11 and 12 and the bottom plate 13. A bracket 131 for mounting the electromagnetic counter on a machine, not shown, is secured to the bottom plate 13. The upper portion 15 of the back plate 14 is bent inwardly to extend in parallel with the bottom plate 13 thus forming the yoke of an electromagnetic driving device to be described later. Aligned grooves 151 and 152 are formed on both sides of the bent portion 15 near its inner end and the side edges 153 and 154 are secured to the side plates 11 and 12 respectively. A spring anchor 155 is formed at the center of the inner edge of the bent portion. Three pairs of aligned openings 111, 121; 112, 122; and 113, 123 are provided for the side plates 11 and 12. A digit wheel assembly is mounted between the side plates with its shaft 2, rotatably received in the first pair of openings 111, 121. A plurality of digit wheels made of plastic 21 through 26 are rotatably mounted on the shaft 2 and are urged by a spring 27 toward the side plate 11. A star wheel 211 is secured to the side surface of the first order digit wheel 21 facing the side plate 11 and a segment gear is secured to a portion of the opposite side surface for carrying the order of magnitude. Digit wheels 22, 23, 24 and 25 are provided with pinions 221, 231, 241 and 251 respectively on their side surfaces facing the side plate 11 and carry segment gears are provided for portions of the peripheries on the opposite side. A pin gear 261 is provided for the side surface of the digit wheel 26 facing the side plate 12. A spring 27 is mounted on the shaft 2 between the digit wheel 26 and the side plate 12. Digits 0 through 9 are printed on the periphery of each digit wheel.

A pinion shaft 3 is mounted between the side plates 11 and 12 in parallel with the digit wheel shaft 2, with the opposite ends of the shaft 3 rotatably received in the second pair of openings 112 and 122. Pinions 31, 32, 33, 34 and 35 are rotatably mounted on the shaft 3 for carrying the digit wheels. A shaft 4 is mounted between the side plates 11 and 12 in parallel with the digit wheel shaft 2, with the opposite ends of the shaft 4 rotatably received in the third pair of openings 113 and 123. The shaft 4 is used as the pivot shaft of a control member 8 to be described later.

An electromagnetic driving device is contained in a space defined by the side plates 11 and 12, bottom plate 13, back plate 14 and the bent portion 15 of the frame. The electromagnetic driving device comprises an electric coil 5, a core 51 parallel with the side plates 11 and 12 with its bottom secured to the back plate 14, an armature 52 mounted on the upper end of the core 51 and extending in parallel with the back plate 14, and a spring 53 for biasing the armature. The lead wires 54 of the coil extend to the outside of the frame through a bushing 55 secured to the side plate 11. The armature 52 is provided with a spring anchor 521 at its lower center, and at the upper end of the armature there are provided arms 522 and 523 extending towards the side plates 11 and 12 respectively. These arms are bent at right angles toward the back plate 14 to extend in parallel with the side plates 11 and 12. On the upper edge of the armature 52 is formed a notch 524 having a width equal to the distance between the bottoms of the grooves 151 and 152. Thus, the bent sides of the arms 522 and 532 extend through the grooves 151 and 152 to a portion above the bent portion 15. The armature biasing spring 53 is mounted under tension between the anchor 155 of the bent portion 15 and the anchor 521 of the armature 52. With this construction, the upper edge of the armature 52 is urged against the lower surface of the bent portion 15 to rotate in the clockwise direction as viewed in FIG. 3. A cross-bar 6 is provided to maintain a predetermined distance between the side plates 11 and 12. A driving member 7 is formed integral with the outer end of one arms 522. The drive member 7 takes the form of a plate extending in parallel with the side plate 11 and comprises a pair of pawls 71 and 72 embracing the star wheel 211. Under the normal condition, one pawl 71 engages the star wheel 211 as shown in FIG. 3 whereas the other pawl 71 is out of engagement with the star wheel 211. The control member 8 is pivotally mounted on the pivot shaft 4 between the driving member 7 and the side plate 11. The control member 8 takes the form of C, and a perforation 81 is provided at its upper end for receiving the pivot shaft 4. Pins 82 and 83 are secured to the central and lower portions of the side surface of the control member 8 facing the star wheel 211. The control member 8 is biased to rotate in the clockwise direction as viewed in FIG. 3 by a spring mounted on the pivot shaft 4, so that the side edge of the control member is urged against one side edge 153 of the bent portion 15. The tension of the spring 41 is selected to the smaller than that of the armature biasing spring 53. One pin 82 engages the side surface of the pawl 71 whereas the other pin 83 engages the tip of the pawl 72. By the engagement of pin 83 and the pawl 72, the control member 8 is held at a point slightly rotated in the counterclockwise direction from a position at which control member 8 engages the side edge 153 of the bent portion 15.

Figure 4:
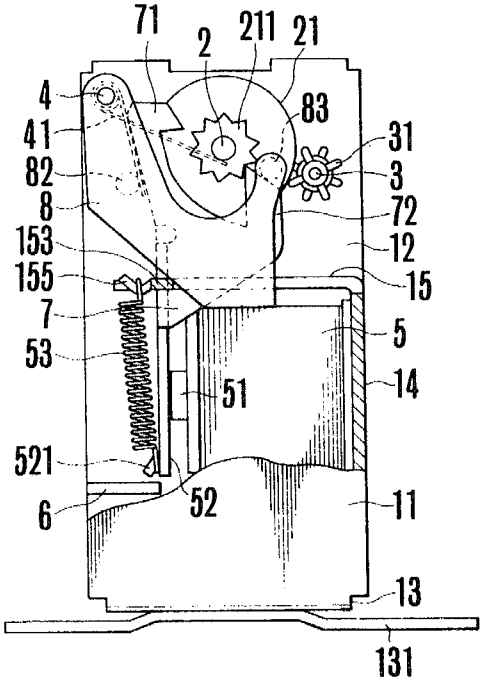
FIG. 4 is a view similar to FIG. 3 showing the counting operation.

When an electric pulse is supplied to the coil 5 through lead wires 54, magnetic flux flows through core 51, back plate 14, bent portion 15 and armature 52. Thus, the armature 52 is attracted by the core 51 to rotate about the arms 522 and 523 extending through the slots 151 and 152 in the counterclockwise direction from the position shown in FIG. 3 to the position shown in FIG. 4 against the force of the spring 53. Accordingly, the driving member 7 integral with the arm 522 of the armature 52 is tilted in the counterclockwise direction to disengage the pawl 71 from the star wheel and engage the pawl 71 with the star wheel 211. By this operation, the star wheel 211 is rotated over step or tooth in the clockwise direction to rotate the first order digit wheel 21 by one half of one digit. When the coil 5 is deenergized the flux disappears. Consequently, the armature 52 is rotated in the clockwise direction from the position shown in FIG. 4 by the force of the spring 53. Consequently, the driving member 7 integral with the arm 522 of the armature 52 is also rotated in the clockwise direction to disengage the pawl 72 from the star gear 211 whereas to engage again the pawl 71 with the star wheel 211. As a consequence, the star wheel 211 is rotated in the clockwise direction by one step so that the first order digit wheel 211 is driven by one half of one digit. Thus the first order digit wheel 21 is driven by an angle corresponding to one digit. Thereafter, the operation described above is repeated, and when the first order digit wheel 21 completes one revolution, the carry segment gear comes to mesh the pinion 31 thereby driving pinion 31. Consequently, the second order digit wheel 22 is driven by an angle corresponding to one digit by gear 221 meshing the pinion 31. The same carry operations are performed for the digit wheels of the higher orders of magnitude thus displaying by the digit wheels the number of pulses applied to the coil.

During the operation described above, the control member 8 does not interfere with the operation of the driving member 7. Since the pin 82 is positioned on one side of the pawl 71, its operation is not prevented. On the otherhand, the second pin 83 is in engagement with the tip of the pawl 72. When the driving member 7 operates to cause the pawl 72 to engage the star wheel 211, the pawl 72 urges the pin 83 to rotate the control member 8 in the clockwise direction. Since the pin 83 slides along the tip of the pawl 72, engagement of the pin 83 with the tip of the pawl 72 does not interfere with the operation of the feed pawl 72.

As has been pointed out hereinabove external shocks and vibrations are often applied to the counter so as to rotate the armature in the counterclockwise direction or move the armature toward lower against the force of the armature biasing spring 53. These shocks and vibrations are also applied to the control member 8. Since the tension of the spring 41 acting upon the control member 8 is selected to be smaller than that of the spring acting upon the armature 52, the control member 8 is more readily affected by the shocks or vibrations than the armature 52. Since the rotation of the control member 8 is prevented by the engagement thereof with arm 153, it is permitted to rotate only in the counterclockwise direction. When the control member 8 rotates in the counterclockwise direction the pin 82 comes to engage the pawl 71 thus preventing the pawl from disengaging from the star wheel 211. Where the vibration and shocks are small, the force of the armature biasing spring 53 and the engagement between the pawl 72 and pin 83 maintain the driving member 7 and the armature in their inoperative positions.

As can be noted from the foregoing description even when external shocks or vibrations are applied the electromagnetic counter of this invention does not misoperate.

It will be clear that the invention is not limited to the specific embodiment described above and that many changes and modifications can be made without departing from the true spirit and scope of the invention. For example, although the back plate 14 and the bent portion 15 were formed integral with the side plates 11 and 12 and with the bottom plate 13 so as to form the yoke of the coil 5, but when the back plate 14 and bent portion 15 are made of nonmagnetic material, the back plate 14 and the bent portion 15 are made of magnetic material and secured to the frame 1. Although the driving member 7 is formed integral with the armature 52, they may be formed separately and then bonded together. The relationship between the pawls 71, 72 and the star wheel 211 may be suitably modified. Although a pair of cam pins 82 and 83 were provided for the control member 8, these pins may be substituted by suitable cam means. Since the relative positions of cam pins 82 and 83 and the pawls 71 and 72 are determined by the relative positions of the star wheel 211 and the pawls 71, 72 any relative positions different from that shown may be used. Instead of journalling the opposite ends of the pivot shaft of the control member 8 by the side plates, the pivot shaft may take the form of a cantilever supported by one of the side plates. Furthermore spring 41 for preventing side play of the digit wheels and spring 27 may be substituted by a single spring. The number of the digit wheels can be increased or decreased.

What is claimed is:

1. An electromagnetic counter comprising:

a frame including a pair of spaced parallel side plates;

a plurality of digit wheels rotatably mounted on a shaft extending between said side plates, a first order digit wheel of said a plurality of digit wheels including a star wheel on one side thereof;

a plurality of pinions rotatably mounted on a pinion shaft extending between said side plates in parallel with said first mentioned shaft for effecting carries of said digit wheels;

a driving member including a pair of feed pawls alternately engaging said star wheel for driving the same;

electromagnetic driving means mounted on said frame for causing said driving member to drive said star wheel; and a control member pivotally mounted on one side plate near said driving member for preventing the driving member from swinging or advancing when an external shock or vibration is applied to said counter thereby to avoid causing said star wheel to misoperate, said control member comprising a C shaped member disposed between one side plate and said driving member, and urged by spring means in a direction opposite to the direction of rotation of said star wheel, said control member pivotally supported at its upper end and provided with a first cam means at about the center of the side surface thereof facing said driving member and a second cam means at the lower end, said first cam means being positioned on one side of one feed pawl and said second cam means engages the tip of the other feed pawl of said driving member, and wherein one of said feed pawls normally engages said star wheel but is moved to one side thereof when said driving member is tilted by said electromagnetic driving means and the other feed pawl is normally held out of engagement from star wheel but engages said star wheel when said driving member is tilted by said electromagnetic driving means.

2. An electromagnetic counter comprising:

a frame made of magnetic material and including a pair of parallel side plates, a bottom plate cooperating with said side plates to form a U shaped structure, said bottom plate being provided with means for mounting the same, and a back plate with three sides thereof connected to said side plates, and said bottom plate, the upper portion of said back plate being bent at right angles to extend in parallel with said bottom plate;

a plurality of digit wheels, a first order digit wheel thereof having a star wheel on one side thereof;

a shaft extending between said side plates for rotatably supporting said digit wheels;

a plurality of shift pinions each interposed between adjacent digit wheels;

a pinion shaft extending between said side plates in parallel with said digit wheel shaft for rotatably supporting said plurality of pinions;

an electromagnetic driving device including a core secured to said back plate to extend in parallel with said bottom plate, an electric coil surrounding said core, an armature pivotally mounted on said bent portion of said back plate, said core, said back plate, and said armature constituting a magnetic circuit, and an armature biasing spring connected between said armature and said bent portion of said back plate;

a driving member extending between a pivot point of said armature and said star wheel in parallel with one of said side plates, and having a pair of pawls alternately engaging said star wheel for driving the same, one pawl normally engaging said star wheel but disengaging therefrom when said driving member is tilted by said electromagnetic driving device, whereas the other pawl being normally disengaged from said star wheel but engaging said star wheel to drive the same when said driving member is tilted by said electromagnetic driving device;

a C shaped control member disposed between one side plate and said driving member, said control member being pivotally supported at the upper end and provided with a first cam member at the center, and a second cam member at the lower end on the surface of said control member facing said driving member, said first cam member being positioned on one side of one of said pawls, said second cam member being in engagement with the other pawl and said control member engaging said bent portion of the back plate;

a shaft extending between said side plates for supporting said control member; and a coil spring mounted about said control member mounting shaft, one end of said coil spring engaging said first cam means for biasing said control member to rotate in a direction opposite to the direction of rotation of said star wheel.

* * * * *